US006979963B2

(12) United States Patent
Katagiri

(10) Patent No.: US 6,979,963 B2
(45) Date of Patent: Dec. 27, 2005

(54) METHOD OF WIRELESSLY CONTROLLING A SEWING MACHINE

(75) Inventor: Kazushige Katagiri, Tainan Hsien (TW)

(73) Assignee: Taiwan Yamamoto Electric Industrial Co. Ltd., Tainan Hsien (TW)

( * ) Notice: Subject to any disclaimer, the term of this patent is extended or adjusted under 35 U.S.C. 154(b) by 0 days.

(21) Appl. No.: 11/055,267

(22) Filed: Feb. 10, 2005

(65) Prior Publication Data

US 2005/0179408 A1 Aug. 18, 2005

(30) Foreign Application Priority Data

Feb. 12, 2004 (TW) ..... 93103329 A

(51) Int. Cl.[7] ..... H02P 7/00; D05B 69/00

(52) U.S. Cl. ..... 318/16; 318/551; 112/277; 112/457

(58) Field of Search ..... 318/551, 16; 388/811; 112/457, 277, 217.3; 700/136

(56) References Cited

U.S. PATENT DOCUMENTS 4,085,691 A * 4/1978 Coughenour et al. ..... 112/457
4,092,938 A * 6/1978 Coughenour et al. ..... 112/457
4,976,552 A * 12/1990 Ishikawa et al. ..... 388/811
5,233,277 A * 8/1993 Kasig et al. ..... 318/551
5,247,449 A * 9/1993 Yoshida ..... 700/136
5,662,055 A * 9/1997 Hartwig et al. ..... 112/102.5
2005/0115481 A1 * 6/2005 Shad ..... 112/277
2005/0139136 A1 * 6/2005 Katagiri ..... 112/217.3

FOREIGN PATENT DOCUMENTS

DE 10024322 C1 * 9/2001 ..... D05B 19/04
GB 2332685 A * 6/1999 ..... D05B 69/18
GB 2376956 A * 12/2002 ..... D05B 69/18
JP 01291892 A * 11/1989 ..... D05B 69/18
WO WO 9951807 A1 * 10/1999 ..... D05B 69/18

* cited by examiner

*Primary Examiner*—Paul Ip
(74) *Attorney, Agent, or Firm*—Abelman, Frayne & Schwab

(57) ABSTRACT

In a method of wirelessly controlling a sewing machine, a wireless receiver module receives an initial signal transmitted wirelessly and continuously from a speed control module in response to a treading action thereon, and stores a preset security code portion of the received initial signal therein. Thereafter, the wireless receiver module receives an incoming control signal transmitted wirelessly from the speed control module in response to a treading action thereon, and controls operation of a motor unit in accordance with a speed control code portion of the received incoming control signal upon detecting that an identification code portion of the received incoming control signal matches the security code portion stored therein.

11 Claims, 10 Drawing Sheets

METHOD OF WIRELESSLY CONTROLLING A SEWING MACHINE

CROSS-REFERENCE TO RELATED APPLICATION

This application claims priority of Taiwanese Application No. 093103329, filed on Feb. 12, 2004.

BACKGROUND OF THE INVENTION

1. Field of the Invention

The invention relates to a wireless control method, more particularly to a method of wirelessly controlling a sewing machine.

2. Description of the Related Art

Control of an internal motor unit of a conventional sewing machine is usually conducted through a pedal-type controller. The rotation speed of the internal motor unit of the sewing machine is varied according to extend of treading action on a pedal of the controller.

When the aforesaid conventional sewing machine is in use, a machine body thereof is usually placed on top of a table, whereas the controller is placed on the ground to permit treading on the same. Therefore, since signal transmission between the controller and the machine body is conducted in a wired manner, a signal cord is required to extend from the top of the table to the ground, thereby resulting in some inconvenience.

To overcome the aforesaid drawback, it has been proposed heretofore to use a wireless mode of transmission between the controller and the machine body. To this end, a transmitter and a receiver are respectively stored with a preset security code therein, and are respectively provided in the controller and the machine body such that the controller converts user treading action into wireless control signals for subsequent transmission by the transmitter to the receiver in the machine body, thereby permitting control of the operation of the motor unit in the machine body.

It is noted that the security code stored in the receiver must match that stored in the transmitter prior to delivery. Hence, the machine body cannot cooperate with other controllers when the original controller malfunctions, thereby resulting in inconvenience during repair.

In such wireless signal transmission between the controller and the machine body, noise interference cannot not be avoided such that a high reliability of the wireless signal transmission cannot be ensured.

Furthermore, the space in the machine body of a conventional sewing machine is fully utilized. Hence, it is not possible to upgrade older sewing machines, which do not allow installation of the receiver inside the machine body, for wireless signal transmission purposes.

SUMMARY OF THE INVENTION

Therefore, the object of the present invention is to provide a method of wirelessly controlling a sewing machine that can eliminate the aforesaid drawbacks of the prior art.

According to the present invention, there is provided a method of wirelessly controlling a sewing machine. The sewing machine includes a main housing, a motor unit disposed in the main housing, a wireless receiver module mounted on the main housing, and a speed control module separate from the main housing and operable so as to enable wireless transmission of signals to the wireless receiver module in response to a treading action thereon. The method comprises the steps of:

a) enabling operation of the speed control module for transmitting wirelessly and continuously an initial signal to the wireless receiver module, the initial signal including a preset security code portion;

b) enabling the wireless receiver module to receive the initial signal from the speed control module and to store the security code portion of the received initial signal therein;

c) enabling operation of the speed control module for transmitting wirelessly an incoming control signal to the wireless receiver module, and enabling the wireless receiver module to receive the incoming control signal from the speed control module, the incoming control signal including an identification code portion and a speed control code portion;

d) configuring the wireless receiver module to verify whether the identification code portion of the received incoming control signal matches the security code portion stored therein; and e) when a match is detected, controlling operation of the motor unit in accordance with the speed control code portion of the incoming control signal received by the wireless receiver module.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
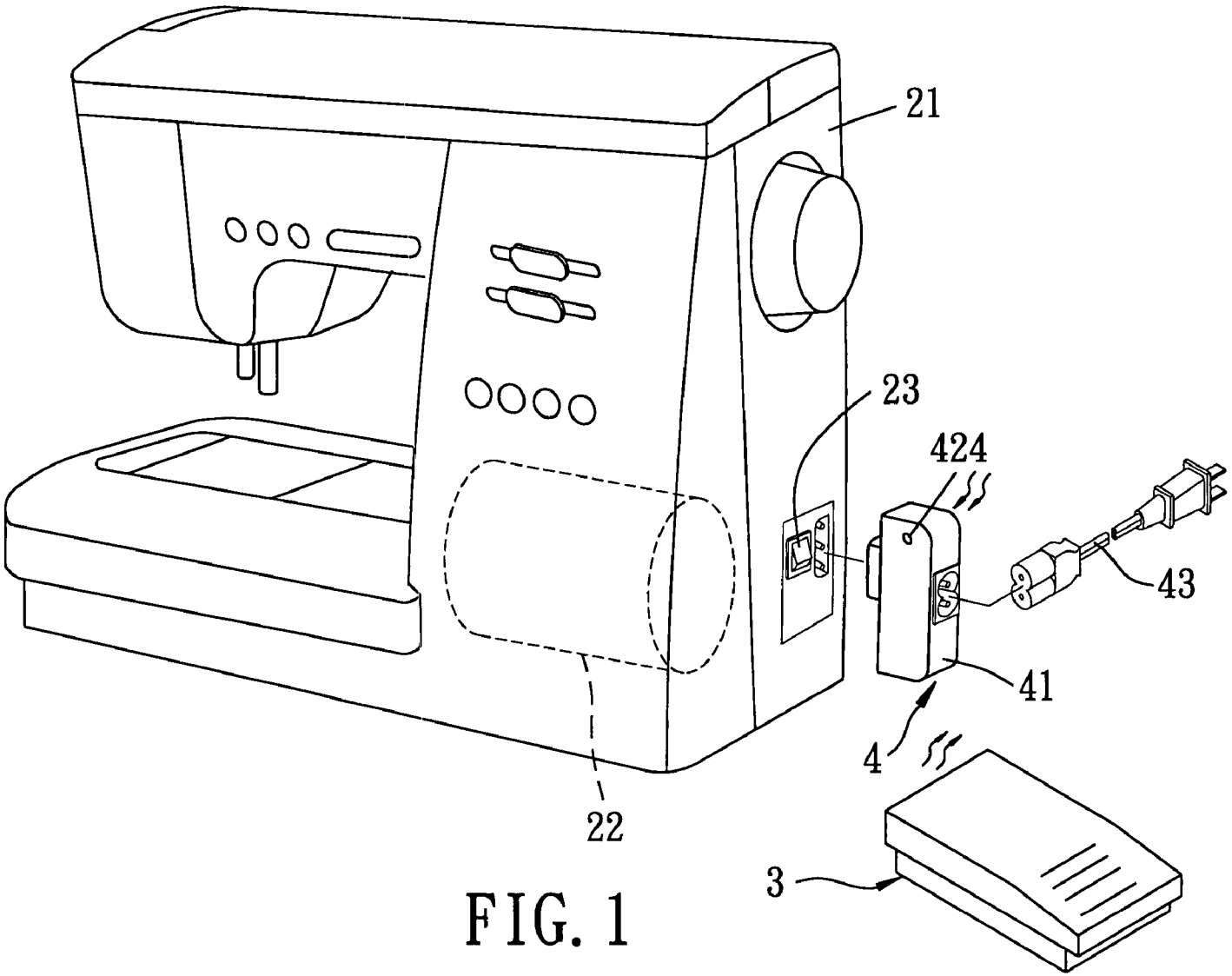
FIG. 1 is a partly exploded perspective view illustrating a sewing machine that is configured for implementing the preferred embodiment of a wireless control method of the present invention.
Figure 5:
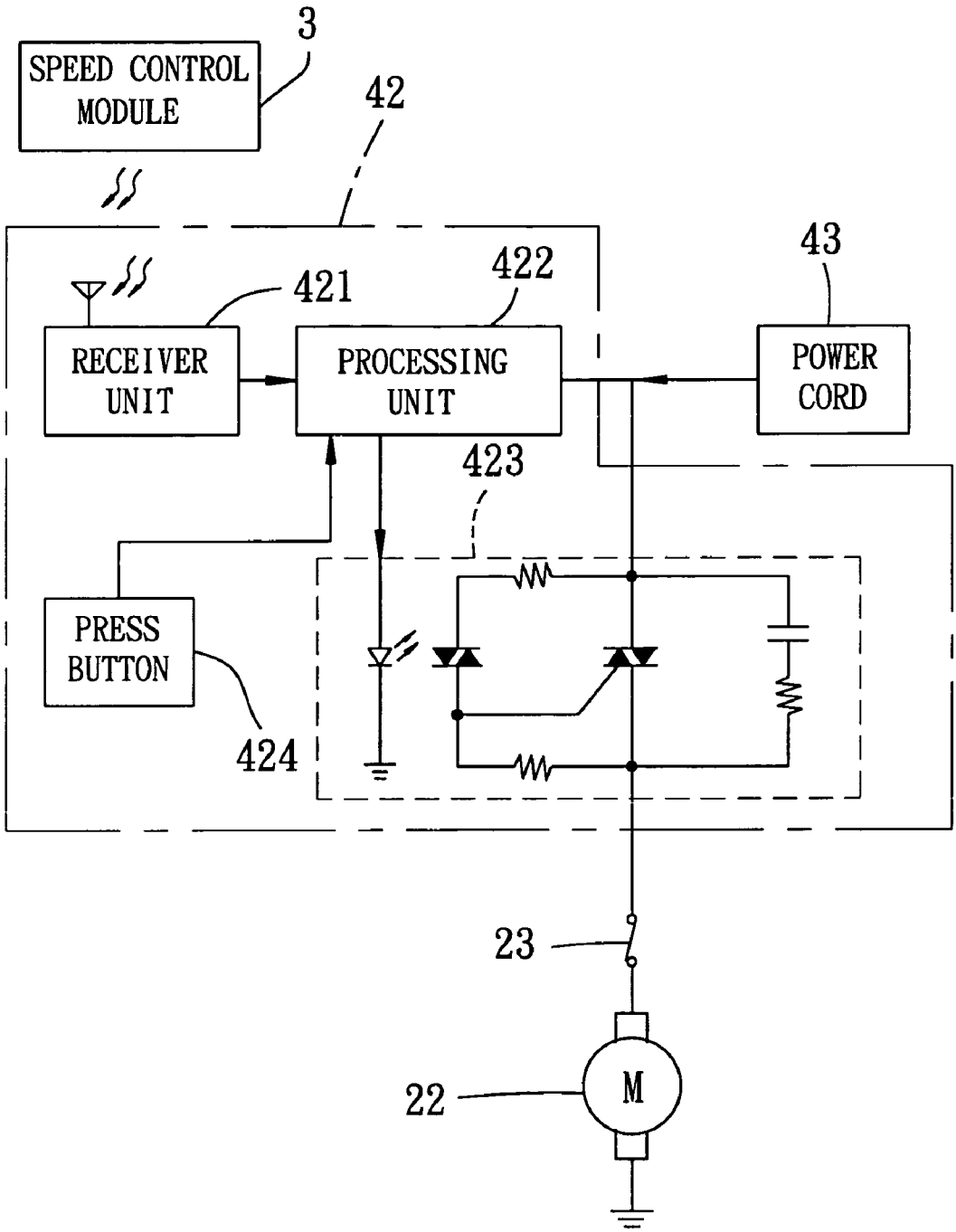
FIG. 5 is a schematic circuit block diagram of the sewing machine in the preferred embodiment.

FIGS. 1 and 5 illustrate a sewing machine that is configured to implementing the preferred embodiment of a wireless control method according to the present invention. The sewing machine includes a main housing 21, a motor unit 22 disposed in the main housing 21, a wireless receiver module 4 mounted detachably on the main housing 21, a switch 23 for making and breaking electrical connection between the motor unit 22 and the wireless receiver module 4 when the wireless receiver module 4 is mounted on the main housing 21, and a speed control module 3 separate from the main housing 21 and operable so as to enable wireless transmission of signals to the wireless receiver module 4 in responses to a treading action in a conventional manner.

Figure 2:
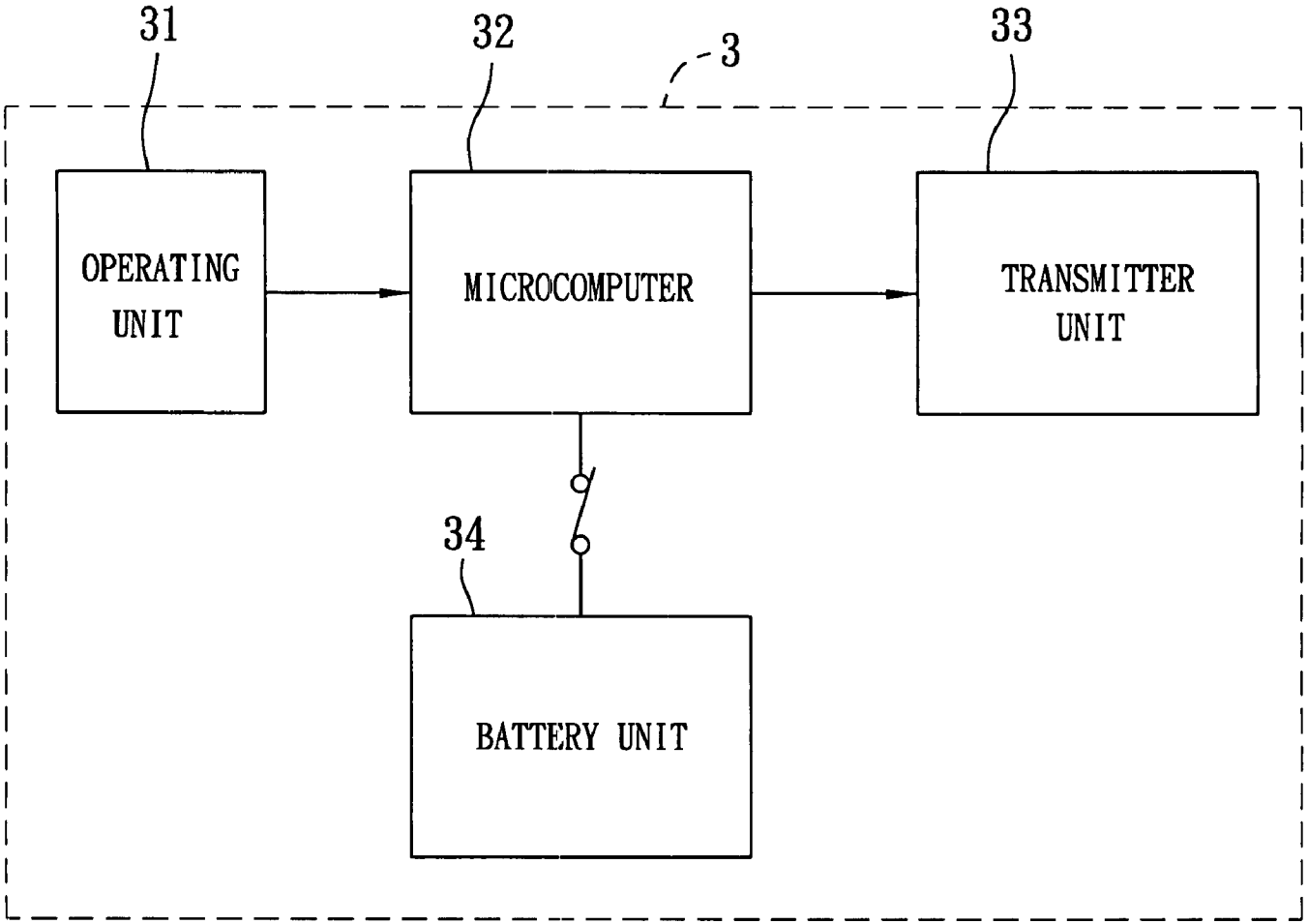
FIG. 2 is a schematic circuit block diagram illustrating a speed control module of the sewing machine in the preferred embodiment.

Referring to FIG. 2, the speed control module 3 includes an operating unit 31, a microcomputer 32, a transmitter unit 33, and a battery unit 34.

The operating unit 31 is operable so as to output analog signals in response to a treading action thereon.

The microcomputer 32 is coupled to the operating unit 31 for receiving the analog signals therefrom, and outputs digital signals corresponding to the analog signals from the operating unit 31.

The transmitter unit 33 is coupled to the microcomputer 32, and is controlled by the microcomputer 32 to wirelessly transmit control signals corresponding to the digital signals from the microcomputer 32. In this embodiment, an AM module (not shown) is used to transmit the control signals. In other embodiments, an FM module can also be used. Furthermore, the control signals can be transmitted using amplitude shift key (ASK) modulation, frequency shift key (FSK) modulation, etc.

The battery unit 34 is coupled to the microcomputer 32, and supplies electric power to the microcomputer 32.

Figure 3:
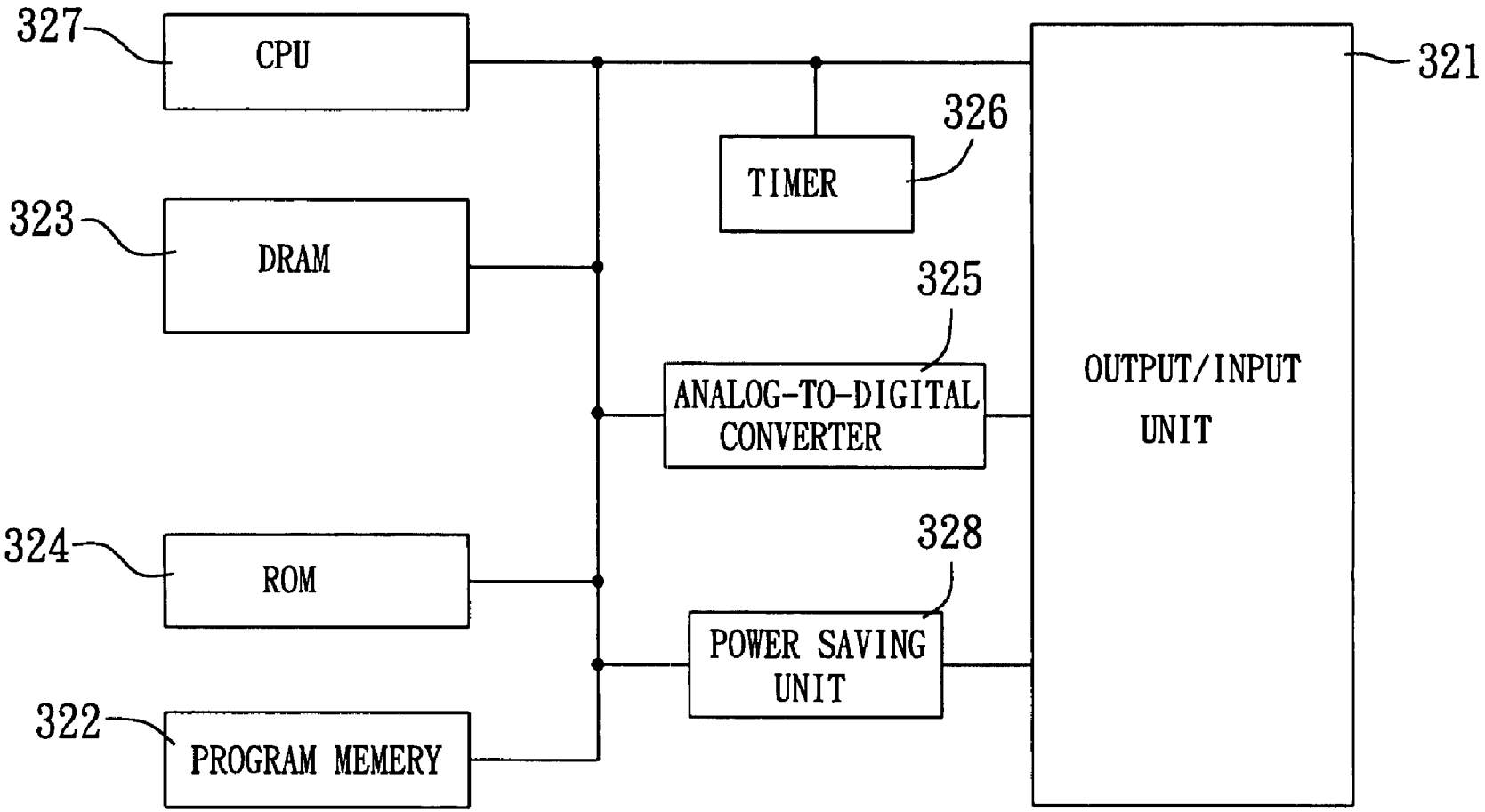
FIG. 3 is a schematic circuit block diagram illustrating a microcomputer of the speed control module of the sewing machine in the preferred embodiment.

In this embodiment, referring to FIG. 3, the microcomputer 32 includes an output/input unit 321, a program memory 322, such as a flash program memory, a DRAM 323 that serves as a data buffer, a ROM 324, such as an EEP-ROM, an analog-to-digital converter 325, a timer 326, a CPU 327, and a power saving unit 328.

The output/input unit 321 is coupled to the operating unit 31, the transmitter unit 33 and the battery unit 34.

The analog-to-digital converter 325 is coupled to the output/input unit 321 and the memories 323, 324, 322, and converts the analog signals from the operating unit 31 via the output/input unit 321 into the digital signals.

The CPU 327 is coupled to the output/input unit 321, the analog-to-digital converter 325 and the memories 323, 324, 322.

The timer 326 is coupled to the CPU 327, the memories 323, 324, 322, and the output/input unit 321, and provides an internal timing signal.

The power saving unit 328 is coupled to the output/input unit 321, the converter 325, the memories 323, 324, 322, the timer 326 and the CPU 327, and manages supply of the electric power from the battery unit 34 via the output/input unit 321 to the whole microcomputer 32.

In the preferred embodiment, the speed control module 3 is configured to operate in a sleep mode when the speed control module has remained idle for a predetermined time period, such as 5 minutes. More specifically, when the power saving unit 328 detects that no analog signal from the operating unit 31 via the output/input unit 321 has been received thereby within the predetermined time period, the power saving unit 328 is operated in a power-saving mode so as to enable the CPU 327 to operate in the sleep mode, thereby reducing power consumption. Of course, the transmitter unit 33 does not transmit any signal when the CPU 327 is in the sleep mode.

On the other hand, the speed control module 3 is configured to wake up from the sleep mode in response to a treading action on the operating unit 31. More specifically, when the operating unit 31 outputs an actuating signal in response to a treading action thereon, such as a maximum treading action, to the power-saving unit 328 via the output/input unit 321, the power-saving unit 328 resumes operation to a normal mode from the power-saving mode so as to enable the CPU 327 to wake up from the sleep mode.

As shown in FIGS. 1 and 5, the wireless receiver module 4 includes a rectangular housing 41, a receiver device 42 mounted in the housing 41, and a power cord 43 adapted for connecting the receiver device 42 to a power source (not shown), such as a commercial AC power source (see FIG. 1).

The receiver device 42 includes a receiver unit 421, a processing unit 422, a driving unit 423 and a press button 422 (see FIG. 5).

The receiver unit 421 receives the signals transmitted from the speed control module 3.

The processing unit 422 is connected to the receiver unit 421 for processing the signals received by the receiver unit 421 in accordance with a proprietary computer program associated with the method of the preferred embodiment.

The driving unit 423 is connected to the processing unit 422 and the switch 23, and is controlled by the processing unit 422 in accordance with the signals received by the receiver unit 421 so as to generate corresponding motor control output.

The press button 424 is provided on the housing 41, is coupled to the processing unit 422, and is manually operable for setting up the processing unit 422.

Figure 6:
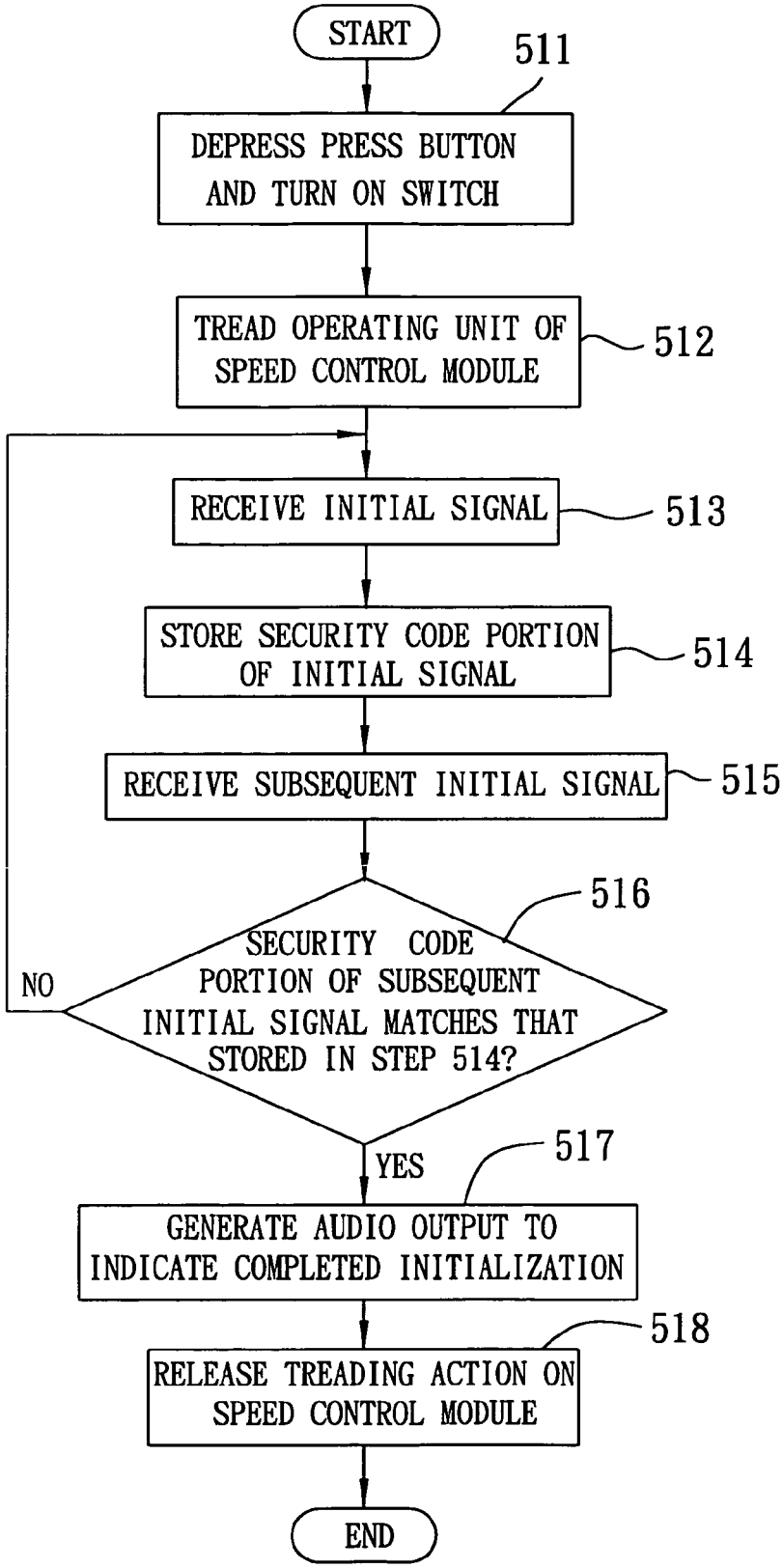
FIG. 6 is a flow chart illustrating how the sewing machine is initialized in accordance with the method of the preferred embodiment.

Referring to FIG. 6, there is shown a flow chart to illustrate how the sewing machine is initialized in accordance with the method of the preferred embodiment.

In step 511, the press button 424 of the receiver device 42 is depressed, and the switch 23 is turned on such that the sewing machine is set up to an initialized mode.

Figure 4A:
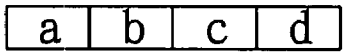
FIGS. 4*a* to 4*d* are schematic views illustrating how a control signal is formed.

In step 512, the operating unit 31 of the speed control module 3 is treaded so as to enable the speed control module 3 to transmit wirelessly and continuously a control signal serving as an initial signal to the wireless receiver module 4 in response to the treading action on the operating unit 31. The initial signal includes a preset security code portion that had been stored in the EEP-ROM 324 of the microcomputer 32 prior to delivery in this embodiment, whereas, in other embodiments, the security code portion can be preset by generating a digital count output, in a count unit of $1\mu$ second, corresponding to a treading action on the operating unit 31, by using a dip switch unit, or by using a random code generator. In this embodiment, the security code portion of the initial signal has four bit sets (a, b, c, d), each of which has 4 bits, as shown in FIG. 4*a*.

In step 513, the receiver unit 421 of the wireless receiver module 4 is configured to receive the initial signal transmitted initially from the speed control module 3 in step 512.

In step 514, the processing unit 422 of the receiver device 42 is configured to store the security code portion of the initial signal initially received by the receiver unit 421 in step 513 in a predetermined memory, such an EEP-ROM, of the processing unit 422.

In step 515, the receiver unit 421 of the receiver device 42 is configured to receive the initial signal transmitted subsequently from the speed control module 3.

In step 516, the processing unit 422 of the receiver device 42 is configured to verify whether the security code portion of the initial signal subsequently received by the receiver unit 421 in step 515 matches that stored in step 514. When a match is not detected, steps 513, 514, 515 are repeated.

In step 517, when a match is detected, initialization of the sewing machine is completed, and the wireless receiver module 4 is configured to generate an audio output for indication purposes.

In step 518, the treading action on the operating unit 31 of the speed control module 3 is released.

Figure 7:
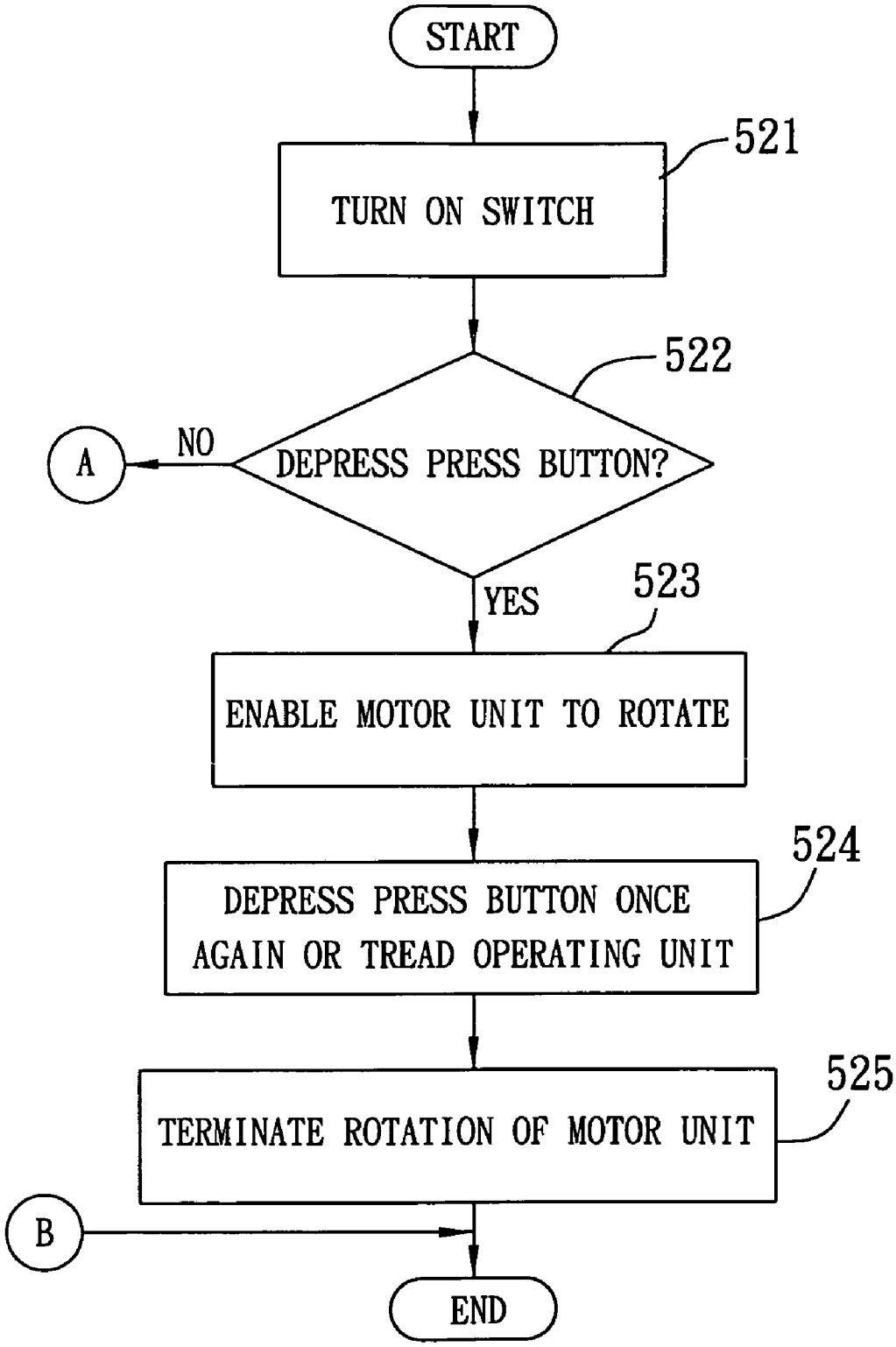
FIG. 7 is a flow chart illustrating how the sewing machine is manually controlled.

Regardless of initialization, the sewing machine can be manually controlled in this embodiment. Referring to FIG. 7, there is shown a flow chart to illustrate how the sewing machine is manually controlled. In step 521, the switch 23 of the wireless receiver module 4 is turned on. In step 522, the processing unit 422 of the receiver device 42 is configured to detect whether the press button 424 of the receiver device 42 is depressed. In step 523, when the press button 424 is depressed, the processing unit 422 is configured to enable the motor unit 22 to rotate continuously in a predetermined speed. In step 524, the press button 424 is depressed once again, or a treading action on the operating unit 31 of the speed control module 3 only upon completing initialization is made so as to enable the processing unit 422 to terminate rotation of the motor unit 22 and to generate an audio output to indicate termination of rotation of the motor unit 22, as described in step 525.

Figure 4B:
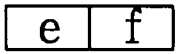
Figure 4C:
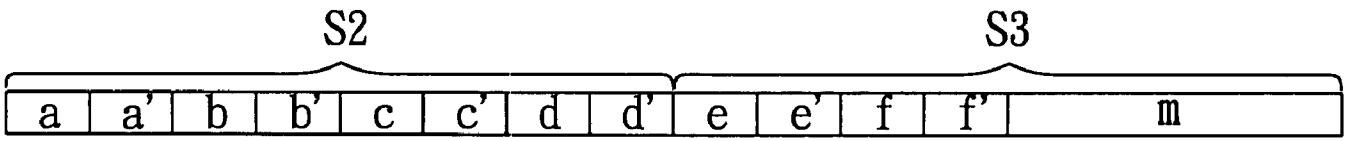
Figure 4D:
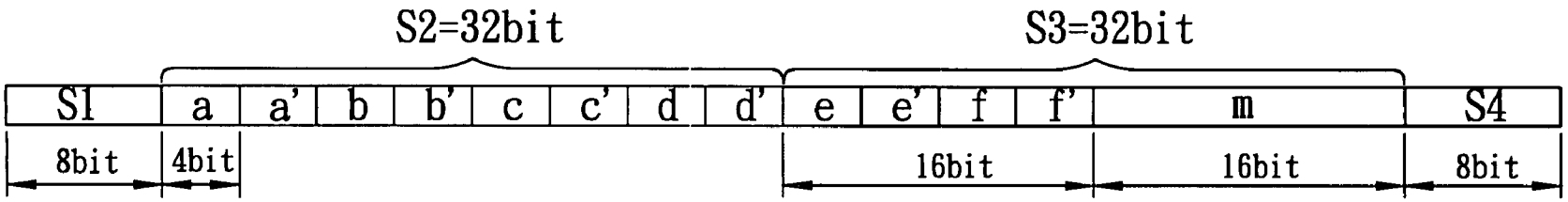

It is only after initialization that the sewing machine can be wirelessly controlled in accordance with the method of the preferred embodiment. It is noted that, since the AM module in the transmitter unit 33 is utilized for wireless signal transmission as a result of lower costs and lower power-consumption, noise interference cannot not be avoided such that a high reliability of the wireless signal transmission cannot be ensured. To overcome the aforesaid drawback, each control signal transmitted from the transmitter unit 33 of the speed control module 3 includes an identification code portion that has four bit sets (a, b, c, d) (see FIG. 4*a*), a speed control code portion that has two bit sets (e, f,) (see FIG. 4*b*), a first check code portion, which has four bit sets (a', b' c' d') (see FIG. 4*c*), corresponding to and associated with the identification code portion, a second check code portion, which has two bit sets (e', f') (see FIG. 4*c*), corresponding to and associated with the speed control code portion, an operation code portion (m) that is generated by performing a predetermined logic operation upon the speed control code portion (e, f) and the second check code portion (e', f') and that has the same total number of bits as that of the speed control code portion (e, f) and the second check code portion (e', f'), i.e., 16 bits, an 8-bit start code portion (S1), and an 8-bit end code portion (S4). In other words, the 8-bit start code portion (S1), a combination (S2) of the bit sets (a, a' b, b', c, c', d', d') totalling 32 bits, a combination (S3) of the bit sets (e, e', f, f') totalling 16 bits and the 16-bit operation code portion (m), and the 8-bit end code portion (S4) form each control signal with a total of 80 bits, as shown in FIG. 4*d*. For example, if each of the bit sets (a', b', c', d', e', f') is generated by performing logic operations of NOT+1 upon a corresponding one of the bit sets (a, b, c, d, e, f), when the bit set (a) is "1001", the bit set (a') is thus "0111". In another example, the operation code portion (m) is generated by performing logic operations of NOT+1 in upon the bit sets (e, e', f, f').

Figure 8A:
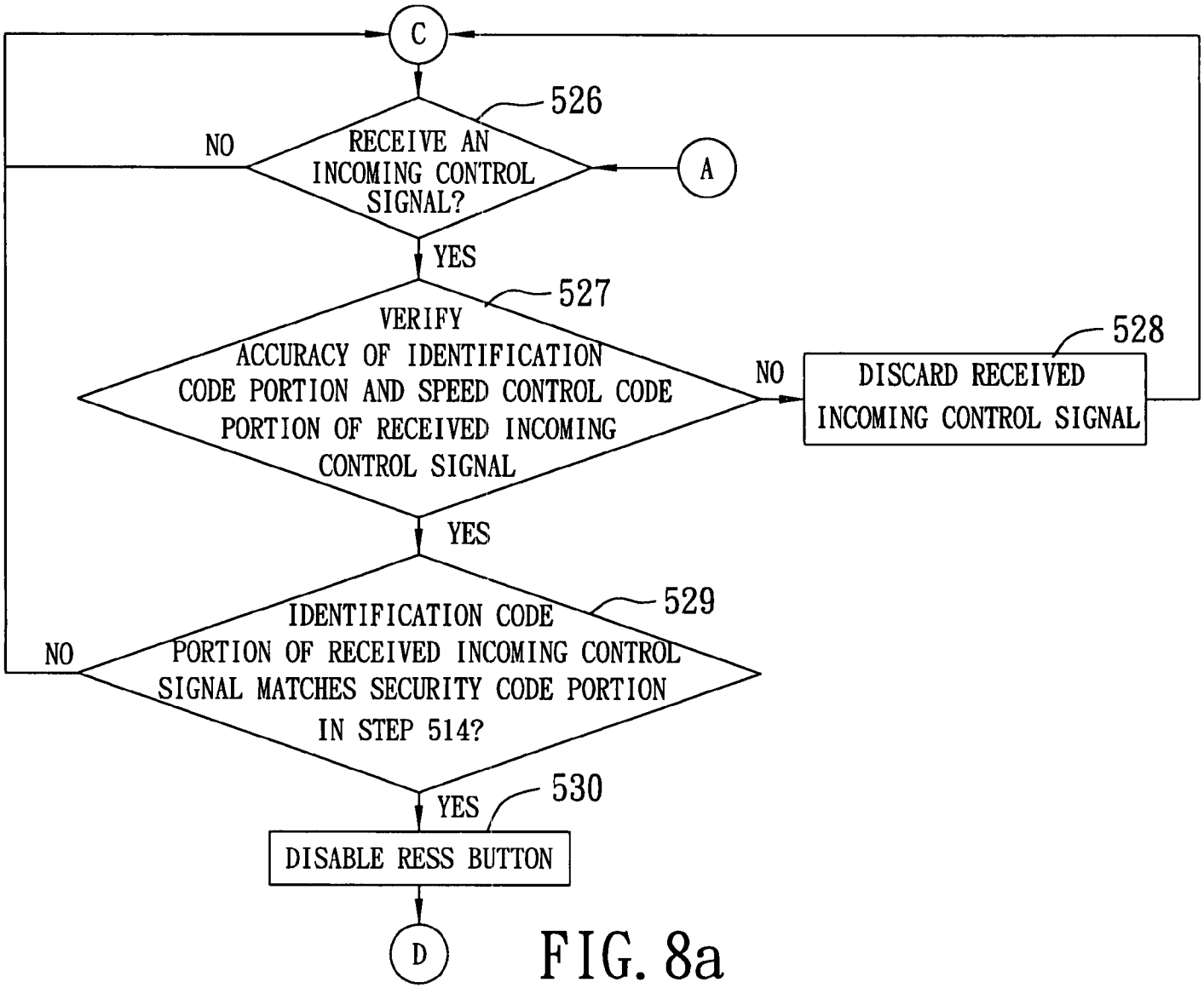
FIGS. 8*a* and 8*b* are flow charts illustrating how the sewing machine is wirelessly controlled after initialization in accordance with the method of the preferred embodiment.
Figure 8B:
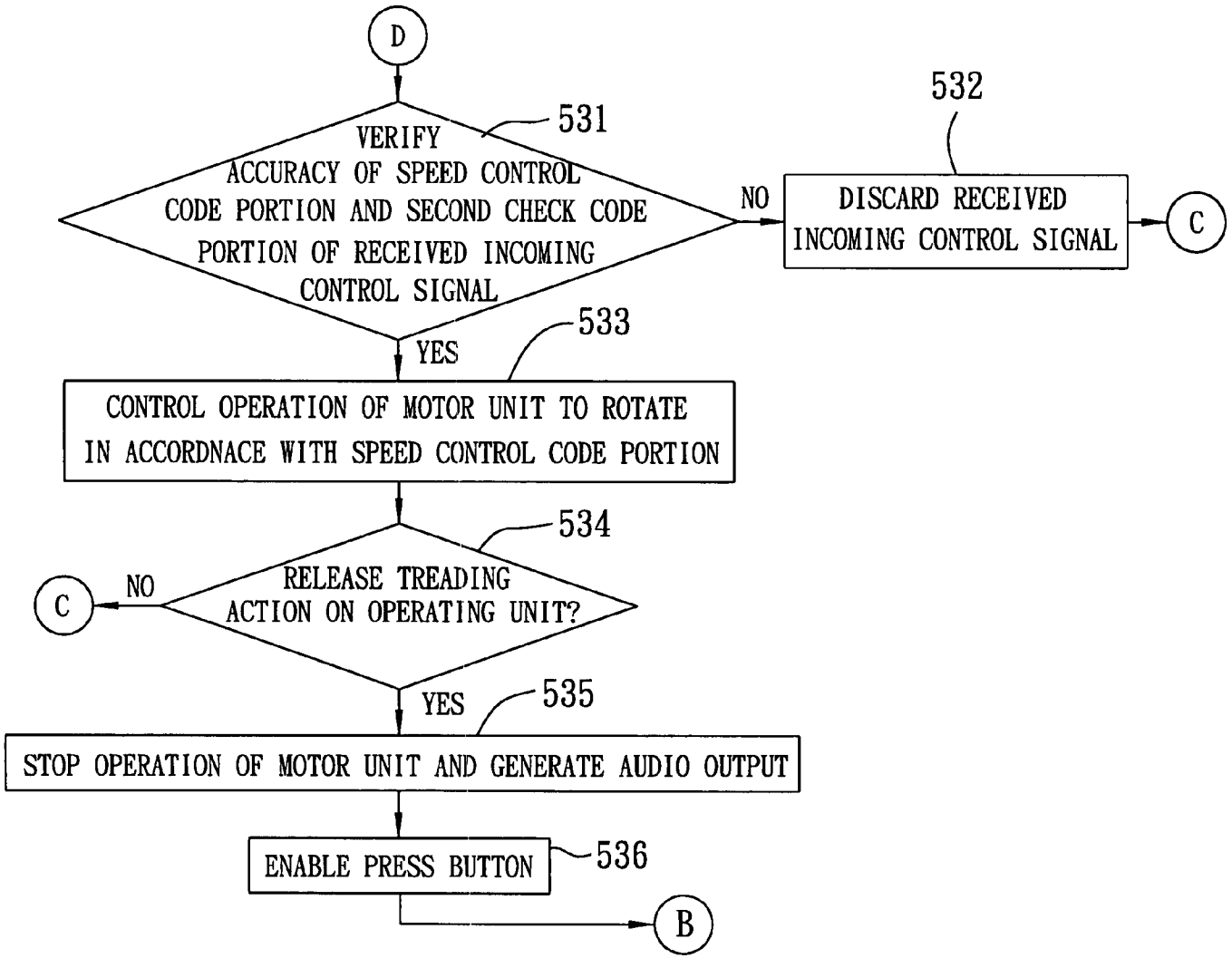

Referring to FIGS. 8*a* and 8*b*, there are shown flow charts to illustrate how the sewing machine is wirelessly controlled after initialization in accordance with the method of the preferred embodiment.

In step 526, when the press button 424 of the receiver device 42 is not depressed, the processing unit 422 of the receiver device 42 is configured to detect whether the receiver unit 421 of the receiver device 42 receives an incoming control signal transmitted from the speed control module 3.

In step 527, when the processing unit 422 detects that the receiver unit 421 receives an incoming control signal, i.e., the operation of the speed control module for transmitting wirelessly the incoming control signal to the wireless receiver module 4 has been performed, the processing unit 422 is configured to verify accuracy of the identification code portion (i.e., the bit sets (a, b, c, d)) and the speed control code portion (i.e., the bit sets (e, f)) of the incoming control signal received by the receiver unit 421 with reference to the first check code portion (i.e., the bit sets (a', b', c', d')) and the second check code portion (i.e., the bit sets (e', f')) of the incoming control signal received by the receiver unit 421.

In step 528, when one of the identification code portion (i.e., the bit sets (a, b, c, d)) and the speed control code portion (i.e., the bit sets (e, f)) of the incoming control signal received by the receiver unit 421 is found to be inaccurate as a result of noise interference, the incoming control signal received by the receiver unit 421 is discarded, and the flow returns to step 526.

In step 529, when the accuracy is detected in step 527, the processing unit 422 is configured to verify whether the identification code portion (i.e., the bit sets (a, b, c, d)) of the received incoming control signal matches the security code portion stored therein in step 515 of FIG. 7.

In step 530, when a match is detected in step 529, the processing unit 422 is configured to disable the press button 424. In other words, the sewing machine is maintained for operation in the wireless control mode. If a match is not detected in step 529, the flow returns to step 526.

In step 531, the processing unit 422 is configured to verify accuracy of the speed control code portion and the second check code portion (i.e., the bit sets (e, e', f, f')) of the incoming control signal received by the receiver unit 421 with reference to the operation code portion (m) of the received incoming control signal. For example, according to the example described above, the operation code portion (m) is obtained by logic operations of NOT+1 upon the bit sets (e, e', f, f') such that the accuracy occurs when a logic sum of the bit sets (e, e', f, f') and the operation code portion (m) is zero (i.e., all the 16 bits of the logic sum are "0").

In step 532, when the verification result of step 531 is inaccurate as a result of noise interference, the incoming control signal received by the receiver unit 421 is discarded, and the flow returns to step 526.

In step 533, when the verification result of step 531 is accurate, the processing unit 422 is configured to control operation of the motor unit 22 to rotate in accordance with the speed control code portion (i.e., the bit sets (e, f)) of the incoming control signal received by the receiver unit 421.

In step 535, when releasing of the treading action on the operating unit 31 is verified in step 534, the processing unit 422 enables the motor unit 22 to stop rotation, and generates an audio output for indication purposes. If it is determined in step 534 that the treading action on the operating unit 31 continues, the flow returns to step 526.

Finally, in step 536, the processing unit 422 is configured to enable the press button 424.

The following are some of the advantages attributed to the method of the present invention:

1. The sewing machine according to the method of this invention can be initialized as desired. Hence, even when one of the wireless receiver module 4 and the speed control module 3 is damaged, the damaged one can be replaced without worrying about any mismatch.

2. Due to the presence of the first and second check code portions and the operation code portion of the control signal, a high reliability of the wireless signal transmission between the speed control module 3 and the wireless receiver module 4 can be ensured.

3. The security code portion of the initial signal can be set up by user, thereby resulting in flexibility and convenience in use.

4. Because the wireless receiver module 4 is not required to be disposed in the machine body 21, older sewing machines can be easily upgraded for use with the wireless receiver module 3 in this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A method of wirelessly controlling a sewing machine, the sewing machine including a main housing, a motor unit disposed in the main housing, a wireless receiver module mounted on the main housing, and a speed control module separate from the main housing and operable so as to enable wireless transmission of signals to the wireless receiver module in response to a treading action thereon, said method comprising the steps of:

a) enabling operation of the speed control module for transmitting wirelessly and continuously an initial signal to the wireless receiver module, the initial signal including a preset security code portion;

b) enabling the wireless receiver module to receive the initial signal from the speed control module and to store the security code portion of the received initial signal therein;

c) enabling operation of the speed control module for transmitting wirelessly an incoming control signal to the wireless receiver module, and enabling the wireless receiver module to receive the incoming control signal from the speed control module, the incoming control signal including an identification code portion and a speed control code portion;

d) configuring the wireless receiver module to verify whether the identification code portion of the received incoming control signal matches the security code portion stored therein; and e) when a match is detected, controlling operation of the motor unit in accordance with the speed control code portion of the incoming control signal received by the wireless receiver module.

2. The method as claimed in claim 1, wherein the security code portion is preset by generating a digital count output corresponding to a treading action on the speed control module.

3. The method as claimed in claim 1, wherein the security code portion is preset using a dip switch unit.

4. The method as claimed in claim 1, wherein the security code portion is preset using a random code generator.

5. The method as claimed in claim 1, wherein step b) includes the sub-steps of:

b-1) enabling the wireless receiver module to receive the initial signal transmitted initially from the speed control module;

b-2) storing the security code portion of the initial signal initially received by the wireless receiver module in sub-step b-1);

b-3) enabling the wireless receiver module to receive the initial signal transmitted subsequently from the speed control module and to verify whether the security code portion of the initial signal subsequently received by the wireless receiver module matches that stored in sub-step b-2); and b-4) repeating sub-steps b-1) to b-3) when a match is not detected.

6. The method as claimed in claim 1, wherein, in step c), the incoming control signal further includes a first check code portion corresponding to and associated with the identification code portion, and a second check code portion corresponding to and associated with the speed control code portion.

7. The method as claimed in claim 6, further comprising, prior to step d):

verifying accuracy of the identification code portion and the speed control code portion of the incoming control signal received by the wireless receiver module in step c) with reference to the first and second check code portions of the incoming control signal received by the wireless receiver module in step c); and when one of the identification code portion and the speed control code portion is found to be inaccurate, discarding the incoming control signal received by the wireless receiver module in step c).

8. The method as claimed in claim 6, wherein, in step c), the incoming control signal further includes an operation code portion that is generated by performing a predetermined logic operation upon the speed control code portion and the second check code portion and that has the same total number of bits as that of the speed control code portion and the second check code portion.

9. The method as claimed in claim 8, wherein step e) includes the sub-steps of:

e-1) when a match is detected in step d), verifying accuracy of the speed control code portion and the second check code portion of the incoming control signal received by the wireless receiver module in step c) with reference to the operation code portion of the received incoming control signal;

e-2) when the verification result of step e-1) is inaccurate, discarding the incoming control signal received by the wireless receiver module in step c); and e-3) when the verification result of step e-1) is accurate, controlling operation of the motor unit to rotate in accordance with the speed control code portion of the incoming control signal received by the wireless receiver module in step c).

10. The method as claimed in claim 1, further comprising the step of enabling the speed control module to operate in a sleep mode when the speed control module has remained idle for a predetermined time period.

11. The method as claimed in claim 10, further comprising the step of enabling the speed control module to wake up from the sleep mode in response to a treading action on the speed control module.

* * * * *